United States Patent [19]

Brendle et al.

[11] 4,263,009

[45] Apr. 21, 1981

[54] METHOD FOR IMPROVING THE DYEING CHARACTERISTICS OF TEXTILE MATERIALS CONTAINING POLYOLEFIN FIBERS AND PRODUCTS PRODUCED THEREBY

[75] Inventors: Ralph N. Brendle; John W. Miley; George A. Allen, all of Spartanburg, S.C.

[73] Assignee: Milliken Research Corporation, Spartanburg, S.C.

[21] Appl. No.: 71,927

[22] Filed: Sep. 4, 1979

Related U.S. Application Data

[60] Continuation of Ser. No. 873,994, Jan. 31, 1978, abandoned, which is a division of Ser. No. 770,878, Feb. 22, 1977, abandoned.

[51] Int. Cl.[3] ..... D06P 3/79; D06M 13/46

[52] U.S. Cl. ..... 8/495; 8/554; 427/389.9

[58] Field of Search ..... 8/31, 100 R, 180, 168 D, 8/495, 554, 541, 542; 427/390 R, 390 B, 388.9

[56] References Cited

U.S. PATENT DOCUMENTS

| | | | |
|---|---|---|---|
| 2,379,413 | 7/1945 | Bradley | 260/404.5 |
| 2,829,071 | 4/1958 | Schroeder | 427/390 R |
| 3,033,706 | 5/1962 | Pardo et al. | 427/390 R |
| 3,044,843 | 7/1962 | Tullio | 8/17 |
| 3,112,159 | 11/1963 | Cappuccio | 8/172 |
| 3,141,728 | 7/1964 | Böckmann et al. | 8/84 |
| 3,314,743 | 4/1967 | Gagliardi | 8/100 |
| 3,335,105 | 8/1967 | Burnthall | 260/2 N |
| 3,397,032 | 8/1968 | Mather et al. | 8/180 |
| 3,436,359 | 4/1969 | Hubin et al. | 260/2 |
| 3,542,502 | 11/1970 | Tesoro | 8/100 |
| 3,553,111 | 1/1971 | Ginilewicz et al. | 260/830 R |
| 3,580,887 | 5/1971 | Halin | 260/47 |
| 3,779,703 | 12/1973 | Tesoro | 8/180 |
| 3,807,946 | 4/1974 | Harper et al. | 8/17 |
| 3,928,269 | 12/1975 | Taylor et al. | 8/DIG. 9 |
| 4,014,645 | 3/1977 | Chancler et al. | 8/1 XB |
| 4,054,542 | 10/1977 | Buckman et al. | 8/85 |

FOREIGN PATENT DOCUMENTS

| | | | |
|---|---|---|---|
| 1082004 | 5/1960 | Fed. Rep. of Germany | 8/84 |
| 43-4201 | 2/1968 | Japan | 8/31 |
| 904998 | 9/1962 | United Kingdom | 8/DIG. 9 |
| 942131 | 11/1963 | United Kingdom | 8/DIG. 9 |
| 1374181 | 11/1974 | United Kingdom . | |

OTHER PUBLICATIONS

Lee et al., "Epoxy Resins", McGraw Hill, N.Y. 1957, pp. 166–168.

Kale et al., Jour. of App. Polymer Sci., vol. 12 (1975), pp. 461–480.

Olson, Textile Chemist & Colorist, vol. 1, #9, pp. 220–224.

Allen and Kuhn, Encyclopedia of Polymer. Sci. & Tech., vol. 15, pp. 314–319.

*Primary Examiner*—Joseph L. Schofer

*Assistant Examiner*—Maria P. Tungol

*Attorney, Agent, or Firm*—H. William Petry; Terry T. Moyer

[57] ABSTRACT

A method for improving the dyeing characteristics of textile materials containing polyolefin fibers is provided wherein the polyolefin fibers are coated with a coating composition consisting essentially of a film forming component containing at least one quaternary ammonium group. A preferred coating composition useful in the practice of the invention further includes a wetting agent and a minor effective amount of a fluorocarbon surfactant. Procedure for forming such coating compositions, application of same to polyolefin fibers, as well as dyeing of the coated polyolefin fibers is disclosed.

In one embodiment the film forming component is the reaction product of a chemical substance containing at least one quaternary ammonium group and at least two amino groups having active hydrogen and a polyepoxide having at least two 1,2-epoxy groups per molecule. A method for producing such a film forming component and application of same to a textile material containing polyolefin fibers is also set forth.

17 Claims, No Drawings

METHOD FOR IMPROVING THE DYEING CHARACTERISTICS OF TEXTILE MATERIALS CONTAINING POLYOLEFIN FIBERS AND PRODUCTS PRODUCED THEREBY

This is a continuation of application Ser. No. 873,994, filed Jan. 31, 1978 now abandoned, which is in turn a divisional of application Ser. 770,878, filed Feb. 22, 1977 now abandoned.

This invention relates to a method for improving the dyeing characteristics of textile materials containing polyolefin fibers. In one aspect, it relates to a method for modifying the surface of polyolefin fibers with a film forming component having at least one quaternary ammonium group to improve the acid dyeability of such fibers. In yet another aspect, it relates to a film modified textile material containing polyolefin fibers having improved dyeability properties.

In still another aspect, it relates to a method for improving the dyeing characteristic of textile materials containing polyolefin fibers employing a film forming reaction product formed by the chemical reaction of a chemical compound containing at least one quaternary ammonium group and at least two amino groups having active hydrogen with an epoxy compound having at least two, 1,2-epoxy groups per molecule.

Most of the synthetic fibers and plastics used in the textile industry to produce textile materials, e.g. polyolefins, such as polyethylene and polypropylene, are colorless. In order to achieve the desired color or artistic and decorative effects, colorants are added to these materials. For example, textile materials produced from polypropylene fibers have been dyed by incorporation of dye receptive sites or dyestuff molecules into the polymer during polymerization. Such has generally been accomplished by copolymerization or grafting techniques. Another technique for imparting color to polyolefins has been to incorporate a predetermined amount of pigment into the polyolefin resin prior to melt extrusion of same.

While the above prior art methods have provided ways to dye or color textile materials containing polyolefin fibers, problems have nevertheless been encountered. Severe limitations of color flexibility have been encountered resulting either in the necessity of large inventories of certain colored polyolefins or the use of the uncolored polyolefins.

Thus, new and improved polyolefin containing textile materials and methods for improving the dyeability of such textile materials which do not suffer from the disadvantage of the prior art materials and methods are constantly being sought.

Therefore, an object of the present invention is to provide a method for improving the dyeing characteristics of textile materials containing polyolefin fibers which does not suffer from the before-mentioned disadvantages of the prior art methods. Another object of the invention is to provide a composition which when applied to textile materials containing polyolefin fibers, readily improves the dyeing properties of such textile materials. These and other objects, advantages and features of the present invention will become apparent to those skilled in the art from a reading of the following disclosure.

According to the present invention, we have discovered a composition which readily improves the dyeing characteristics of textile materials containing polyolefin fibers which consists essentially of a film forming component containing at least one quaternary ammonium group per molecule. According to the invention the composition further includes a wetting agent and a minor effective amount of a fluorocarbon surfactant.

Further, according to the present invention, we have discovered a method for improving the dyeing characteristics of textile materials containing polyolefin fibers which comprises forming an aqueous admixture having a pH in the range of from about 2.0 to about 6.0 consisting essentially of from about 1 to about 36 weight percent of a film forming component containing at least one quaternary ammonium group per molecule, wetting the polyolefin fibers of the textile material with the aqueous admixture, and thereafter heating the wetted textile material for a period of time effective to remove water and allow formation of a cured film on the polyolefin fibers.

Still further according to the present invention we have discovered a method for improving the dyeing characteristics of textile materials containing polyolefin fibers wherein the aqueous admixture applied to said fibers includes, in addition to said film forming component from about 0.2 to about 10 weight percent of a wetting agent and from about 0.01 to about 0.5 weight percent of a fluorocarbon surfactant.

Still further according to the invention, we have discovered a novel composition which readily improves the dyeing characteristics of textile materials containing polyolefin fibers which comprises a film forming reaction product formed by the reaction of a chemical compound containing at least one quaternary ammonium group and at least two amino groups having active hydrogen with a polyepoxide having at least two 1,2-epoxy groups, i.e.

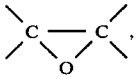

Further according to the invention, we have discovered a method for improving the dyeing characteristics of textile materials containing polyolefin fibers which comprises forming an aqueous admixture consisting essentially of from about 1 to about 36 weight percent of a chemical compound containing at least one quarternary ammonium group and at least two amino groups having active hydrogen, from about 0.2 to about 10 weight percent of a wetting agent, and from about 0.01 to about 0.5 weight percent of a fluorocarbon surfactant; adjusting the pH of the aqueous admixture with an effective amount of a volatile organic acid to provide a pH range for said aqueous admixture of from about 2.0 to about 6.0; incorporating into the pH adjusted aqueous admixture from about 0.5 to about 16 weight percent of a polyepoxide having at least two 1,2-epoxy groups per molecule to form a resulting aqueous admixture; applying said resulting aqueous admixture to said textile materials to wet the polyolefin fibers of said materials; and heating the wetted textile materials to a temperature effective to remove water and volatile organic acid constituents regenerated by such heating and thus free the amino groups having actice hydrogen to provide a polyamine-polyepoxide reaction product modified textile material, said heating also being sufficient to cure said polyamine-polyepoxide reaction product and to bond same to the polyolefin fibers of said textile materials.

In one embodiment, from about 0.5 to about 50 weight percent of a polyamide polymer and an effective amount of a volatile organic acid to substantially neutralize free amine moieties of said polyamide polymer is incorporated into said aqueous admixture prior to the addition of the polyepoxide compound.

Further, according to the invention we have discovered surface-modified textile materials containing polyolefin fibers improved dyeing properties which comprises a textile material substrate formed of polyolefin fibers having impregnated thereon from about 0.1 to about 10 weight percent of a cured film forming component containing at least one quaternary ammonium group per molecule.

Still further according to the invention, we have discovered surface modified textile materials containing polyolefin fibers having improved dyeing properties which comprises a textile material substrate having impregnated thereon from about 0.1 to about 10 weight percent of film forming reaction product derived from the reaction of a chemical compound containing at least one quaternary ammonium group per molecule and at least two amino groups having active hydrogen atoms per molecule with a polyepoxide having at least two, 1,2-epoxy groups per molecule.

The term "film forming" as used herein is to be understood to mean the capability of a substance to form a membrane-like or covering surface or layer on the polyolefin fibers of a textile material and to be securely bonded thereto, thus forming a coherent film on the fibers.

The term "active hydrogen" is to be understood to means hydrogen atoms bonded to a nitrogen atom and capable of reacting with a substance, such as a polyepoxide to open the

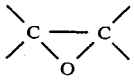

ring of the polyepoxide.

The term "quaternary ammonium group" is to be understood to be

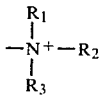

wherein $R_1$ and $R_3$ are similar moieties selected from alkyl or alkyl substituted aromatic moieties containing from 1 to 7 carbon atoms. $R_2$ is an alkyl, alkylene, cycloalkyl, alkyl substituted aromatic or alkylenoxy moiety and such quaternary ammonium group is attached to the composition containing same as a part of the backbone structure of the composition, both internally and terminally, as a side chain to the backbone structure, or combinations thereof.

The term "polyolefin" is to be understood to means polymers derived from olefins such as ethylene, propylene, butylene and mixtures thereof.

The term "textile materials containing polyolefin fibers" is to be understood to mean textile materials produced from polyolefin fibers, such as polyethylene, polypropylene and the like.

As previously stated, the present invention relates to methods and compositions for improving the dyeing properties of textile materials containing polyolefin fibers. In one embodiment the polyolefin fibers are coated with a composition consisting essentially of a film forming component containing at least one quaternary ammonium group per molecule. The amount of the composition applied to the polyolefin fibers can vary widely but a sufficient amount of the composition should be applied to insure a continuous coherent film of such composition of the polyolefin fibers. Generally, it is desirable that the textile material be impreganted and/or coated with a sufficient amount of the composition to provide from about 0.1 to about 10 weight percent of the film forming composition on the polyolefin fibers of the textile material. Especially desirable results have been obtained when the composition applied to the polyolefin fibers contain, in addition to the film forming component, a wetting agent and a minor effective amount of a fluorocarbon surfactant.

Any suitable method can be employed to apply the composition containing the film forming component, and when desired, the wetting agent and the fluorocarbon surfactant, to the polyolefin fibers of the textile materials, such as spraying, padding and the like.

The compositions for improving the dyeing characteristics of textile materials in accordance with the subject invention are applied to the textile substrate as an aqueous admixture. The amount of the film forming component employed in the aqueous admixture can vary widely. However, the aqueous admixture will generally contain from about 1 to about 36 weight percent of the film forming component containing at least one quaternary ammonium group per molecule. Likewise, when employing a wetting agent and a fluorocarbon surfactant in combination with the film forming component the amount of such constituents employed vary widely. However, when employing a wetting agent and a fluorocarbon surfactant it is desirable that the wetting agent be employed in an amount of from about 0.2 to about 10 weight percent and the fluorocarbon surfactant to be employed in an amount of from about 0.01 to about 0.5 weight percent.

The pH of the aqueous admixture can vary widely depending to a large extent upon the film forming component and when applicable the wetting agent and fluorocarbon surfactant, as well as the amount of each of the constituents employed in the aqueous admixture. However, it is generally desirable that the pH of the aqueous admixture be maintained in a range of from about 2.0 to about 6.0.

The above-described aqueous admixtures can then be applied to the textile material containing polyolefin fibers, exercising care to insure that substantially all of the polyolefin fibers are sufficiently wetted with the aqueous admixture. Thereafter, the wetted textile material is heated to a temperature effective to remove the water therefrom and allow formation of a cured film of the film forming component and, when applicable, the wetting agent, and the fluorocarbon surfactant. The temperature at which the wetted textile material is heated can vary widely. However, care should be exercised to insure that the heating temperature does not exceed the softening point of the polyolefin fibers and thus result in degredation of the textile material. Generally, it is desirable to heat the wetted textile material to a temperature of from about 250° F. to about 280° F. for a period of time to remove substantially all of the water therefrom.

The film forming components containing at least one quaternary ammonium group per molecule useful in the practice of the present are those compounds containing at least one functional group represented schematically as

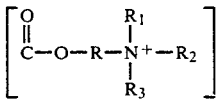

wherein R is an alkyl, alkylene, cycloalkyl or cycloalkylene group, such as $—CH_2—$; $—CH_2—CH_2—$; $—CH_2—CH_2—CH_2—$; $—CH_2—(CH_2)_2—CH_2—$, $—CH=CH—$; $—CH=CH—CH_2—$; $—CH=CH—(CH_2)_2—$; $—CH=CH—(CH_2)_2—CH_2—$;

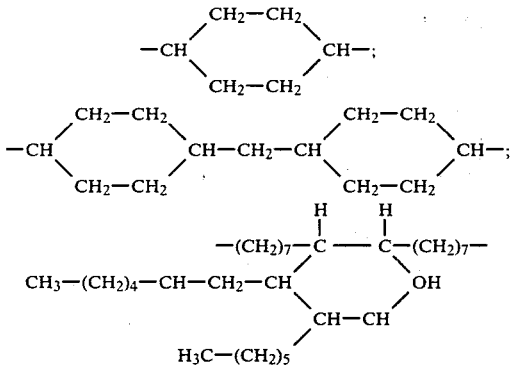

and the like, and $R_1$ and $R_3$ are similar moities selected from alkyl or alkyl substituted aromatic groups containing from 1 to about 7 carbon atoms, such as $—CH_3—$; $—CH_2—CH_3—$; $—CH_2—(CH_2)_5—CH_3—$;

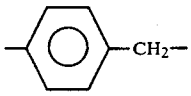

and the like, and $R_2$ is an alkyl, alkylene, cycloalkyl, as previously defined, or an alkyl substituted aromatic group such as

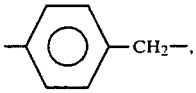

and the like.

The wetting agents useful in the present invention are water-soluble compounds which allow the film forming compound to be maintained substantially uniform on the surface of the polyolefin fibers of the textile material. Especially desirable wetting agents are the alkoxylated phenols, such as the ethoxylated derivative of nonyl phenol, ethoxylated aniline, ethoxylated phenol and the like, and alkoxylated alcohols, such as the ethoxylated derivatives of the $C_{10}$–$C_{18}$ alcohols.

The fluorocarbon surfactants useful in the invention are fluoroalkyl carbonate salts, fluoroalkyl alkoxylates, fluoroalkyl sulfonate salts, fluoroalkyl quaternary ammonium salts, fluoroalkylates and the like. Typical fluorocarbon surfactants which can be employed and are commercially available for each of the above-identified surfactants are Flourad FC-128, Flourad FC-170, Flourad FC-95, Flourad FC-134 and Flourad FC-130, respectively.

The dyeing characteristics of textile materials containing polyolefin fibers can also be improved in accordance with the present invention when the polyolefin fibers are coated with an aqueous consisting essentially of a polyamine-polyepoxide film forming reaction product, a wetting agent, and a minor effective amount of a fluorocarbon surfactant. The polyamine-polyepoxide film forming reaction product is formed as follows:

An aqueous admixture is initially formed consisting essentially of from about 1 to about 36 weight percent of a polyamine containing at least one quaternary ammonium group and at least two amino groups having active hydrogen, from about 0.2 to about 10 weight percent of a wetting agent, and from about 0.01 to about 0.5 weight percent of a fluorocarbon surfactant.

Desirably the aqueous admixture will contain from about 2 to about 10 weight percent of the polyamine, from about 4 to about 6 weight percent of the wetting agent and from about 0.01 to about 0.4 weight percent of the fluorocarbon surfactant.

The pH of the aqueous admixture is then measured, and if necessary adjusted to a pH range of from about 2.0 to about 6.0 by incorporating in the aqueous admixture an effective amount of pH adjusting agent. Desirably the amino groups containing active hydrogen of the polyamine are neutralized, such as by the addition of a volatile organic acid, to prevent premature reaction of the polyamine with the polyepoxide as will be discussed in more detail hereinafter.

After the pH of the aqueous admixture has been determined to be within the desired range of from about 2.0 to about 6.0, an effective amount of a polyepoxide is incorporated into the aqueous admixture to thereby form a resulting aqueous admixture, said polyepoxide being characterized as having at least two 1,2-epoxy groups per molecule and being capable of cross-linking with the polyamine during heating of the resulting aqueous admixture, as will be discussed in more detail hereinafter. The amount of polyepoxide employed can vary widely and will be dependent to a large extent upon the amount and chemical structural of polyamine employed, as well as the amount of any additional polyamide polymer which may also be incorporated. Generally, however, we have found that the amount of polyepoxide employed will be from about 0.5 to 16 weight percent of the resulting aqueous admixture. Especially desirable results can be obtained when the polyepoxide is employed in an amount of from about 4 to about 10 percent.

In addition to the before-mentioned polyamine, it is often desirable to incorporate into the aqueous admixture, prior to formation of the resulting aqueous admixture containing the polyepoxide, a polyamide polymer and an effective amount of a volatile organic acid to substantially neutralize free amine moieties of the polyamide polymers. When employing the additional polyamide in the aqueous admixture, it is necessary to hinder the reaction between the polyamide and polyepoxide until the total constituents of the resulting aqueous admixture have been brought into contact with the textile material being treated. The hindering of such reaction is accomplished by neutralizing the free amine moieties of the polyamide polymer.

The resulting aqueous admixture containing the polyamine, the wetting agent, the fluorocarbon surfactant, the polyepoxide, and in some instances, the neutralized polyamide polymer, is applied to the textile material containing polyolefin fibers to impregnate the textile material and sufficiently wet the fibers thereof. Any suitable means such as padding, dipping, spraying or the like can be employed to wet the textile fibers of the textile material with the resulting aqueous admixture. However, regardless of the method of application sufficient polyamine and polyepoxide constituents should be applied to the fibers of the textile material to provide a reaction product of the total amount of polyamine and polyepoxide on said textile fibers of from about 0.1 to about 10 weight percent, based on the dry weight of the fabric substrate. Desirable results can be obtained when the textile material is wetted with the resulting aqueous admixture in an amount sufficient to provide from about 1 to about 7 weight percent of the polyamine and polyepoxide on the polyolefin fibers of the textile material.

The wetted textile material is then heated to a temperature effective to remove water and the volatile organic acids previously employed to neutralize the amino groups containing active hydrogen and thereby prevent premature reaction between the polyamine and polyamide with the polyepoxy compound.

The temperature at which the wetted fabric is heated can vary widely, as can the length of time required to remove the water and organic acid constituent. Generally, however, the wetted fabric will be heated to a temperature in the range of from about 250° F. to about 280° F. for a period of time of from about 20 seconds to about 5 minutes. The above mentioned heating will, in addition to being that sufficient to remove water and volatile organic constituents, frees the polyamine and, when applicable, the polyamide constituent for reaction with the polyepoxide to provide a polyamine-polyepoxide reaction product modified textile material. Further, such heating is generally sufficient to cure the polyamine-polyepoxide reaction product and to bond such reaction product to the polyolefin fibers of the textile material. If, however, additional curing of the above-described reaction-product is desired and/or required such can be accomplished by subjecting the dried, polyamine-polyepoxide reaction product modified textile material to elevated temperatures of from about 250° F. to about 280° F. for a period of time of from about 5 seconds to about 5 minutes, such depending to a large extent on the particular polyamide or polyamides employed, as well as the particular polyepoxide used.

It should also be noted that a layer-type treatment of the polyamine-polyepoxide reaction product can also be carried out to provide the polyamine-polyepoxide reaction product modified textile materials having improved dyeing properties of the present invention. In such instances, the textile material is first impregnated, by any suitable means as previously discussed, with the resulting aqueous admixture and dried to remove water and if applicable volatile organic acids. Thereafter, the dried, polyamine-polyepoxide reaction product modified textile material is again impregnated with the resulting aqueous admixture, dried, and if required, cured. Care should be exercised, however, when employing the multi-impregnation process set forth above to insure the total amount of polyamine-polyepoxide reaction product is controlled within the desired limits.

The polyamines containing at least one quaternary ammonium group and at least two amino groups having active hydrogen which can be employed in the present invention having at least one functional group represented structurally as

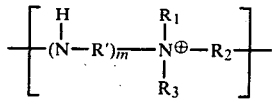

wherein $R_1$ and $R_3$ are as previously defined, $R_2$ and R' are an alkyl, cycloaliphatic, aromatic polyalkyleneoxy, or an amino-substituted alkyl group such as $-(CH_2)-$; $-(CH_2)-_2$; $+(CH_2)_3-$; $+(CH_2)_2-NH-(CH_2)_2$; $-(CH_2)_2-NH-(CH_2)_2-NH-(CH_2)_2-NH-(CH_2)_2-$; $-(CH_2)_3-NH-(CH_2)_3$; $-(CH_2)_3-NH-(CH_2)_3$

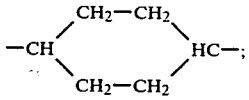

$-CH_2CH_2-(O\ CH_2CH_2)_qO\ CH_2CH_2-$;

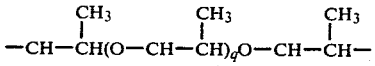

q=0-15

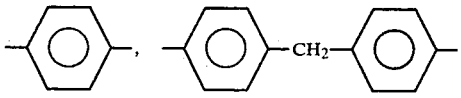

and the like, and m is an integer of at least 1, preferably from 1 to about 10 and the total —NH— groups in said functional group is at least two.

The textile materials containing polyolefin fibers, such as polypropylene, which have been treated with either method or composition set forth as above can readily be dyed with acid dyestuffs using procedures well known by those skilled in the art, such as a continuous pad/steam dyeing process, the Küster dyeing process, an atmospheric Beck dyeing process and the like. However, in producing the products of the present invention, the dyebath employed must contain, as the dyestuff, an anionic or acid dyestuff. Such acid dyestuffs are well known in the art. Illustrative of acid dyestuffs which are commercially available and which can be employed in a dyebath to dye the cured, polymer-modified textile materials of the present invention are Erionyl Yellow 4R
Nylomine Red A2B-100
Nylomine Green C3G
Nylomine Green CG
Xylene Fast Blue PR
Nylomine Blue A-3R
Brilliant Alizarine Milling Blue FGL
Telon Fast Blue A3GL
Irganol Brilliant Yellow 3GLS Telon Yellow GRL
Lanasyn Yellow 2RL
Irgalan Black RBL
Nigrosine Jet L Conc.
Nylosan Black FWL
Tectilon Black GD
Telon Fast Black NW
Intralan Yellow 2BRL
Calcofast Gray G
Telon Yellow Brown 3GL
Nylomine Yellow B3G
Dimacide Light Orange N-R As is well known in the dyeing art, the dyebath will generally contain from about 0.2 to 10 weight percent of such acid dyestuffs, preferably from about 2 to about 5 weight percent. After dyeing, the dyed textile material can be rinsed, dried and heat set, if desired to remove any loosely bound dyestuff. Thereafter the dyed textile material can be further treated to improve the appearance, hand, crock-fastness and the like of the dyed material. The desirability of the further treatment of the dyed textile material will be determined largely by the end use for which the dyed textile material is to be employed.

The molecular weight of the polyamines containing at least one functional group, as defined above, per molecule can vary widely. However, such polyamines will generally have a molecular weight of at least about 600, preferably from about 1,000 to 1,000,000.

The wetting agents useful are as previously defined namely alkoxylated phenols and alkoxylated alcohols. The fluorocarbon surfactants which can be employed have likewise been described hereinbefore.

In addition to the before-mentioned polyamine, wetting agent and fluorocarbon surfactant, it may be desirable, as previously stated, to incorporate into the aqueous admixture a polyamide polymer and an effective amount of a volatile organic acid to substantially neutralize free amine moities of the polyamide polymer. The polyamide polymers which can be employed are those derived from the reaction of polyamines and polybasic acids. Thus, such polyamide polymers contain at least one functional group represented structurally as

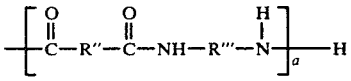

wherein R'' is an alkyl, alkylene, cycloalkyl, cycloalkylene group such as $-CH_2-$; $-CH_2-CH_2-$; $-CH_2-CH_2-CH_2-$; $-CH_2-(CH_2)_2-CH_2-$; $-CH=CH-$; $-CH=CH-CH_2-$; $-CH=CH-(CH_2)_2-$; $-CH=CH-(CH_2)_2-CH_2-$;

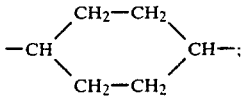

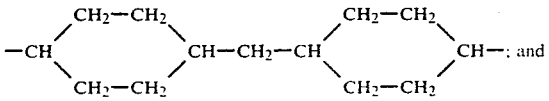

-continued

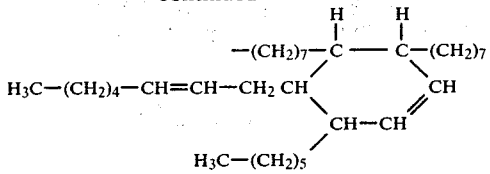

and R''' is an alkyl, cycloaliphatic, aromatic or alkyl group amine substituted such as $-(CH_2)-$; $-(CH_2)_2$; $-(CH_2)_3-(CH_2)_2-NH-(CH_2)_2-$; $-(CH_2)_2-NH-(CH_2)_2-NH-(CH_2)_2-$; $-(CH_2)_2-NH-(CH_2)_2-$; $-(CH_2)_3-NH-(CH_2)_3$; $-(CH_2)_3-$; $-(CH_2)_3-NH-(CH_2)_3$

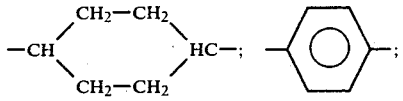

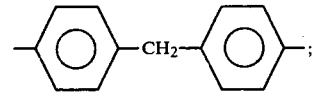

$-CH_2CH_2(O\ CH_2CH_2)_qO\ CH_2CH_2-$;

$-CH_2CH\ (O\ CH_2CH)_qO\ CH_2CH-$; ($CH_3$)

and the like, and a is an integer of from 1 to about 10.

Especially desirable are the polyamides formed by the amination of a polymerized fatty acid, such polyamides being generally represented by the formula

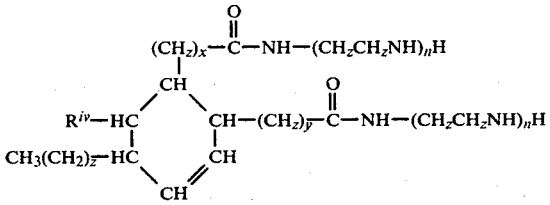

wherein $R^{iv}$ is an alkyl, alkylene, cycloalky or cycloalkylene group as defined hereinbefore, x, y and z are each integers of from 0 to about 12, and n is an integer of from 1 to about 4. For example, $R^{iv}$ will be $H_3C-(CH_2)_4-CH=CH-CH_z-$ when the polyamide is formed from a dimer acid resulting from the Diels-Alder cyclization reaction between 9, 12 and 9, 11 linoleic acids, n will be 2, x and y will be 7 and z will be 5.

When employing the above-identified polyamide polymers in the practice of the present invention, it is necessary to hinder the reaction between the polyamide polymer and the polyepoxide unitl such have been brought into contact with the textile material. Such can, as previously stated, be accomplished by employing an effective amount of a volatile organic acid to convert the free amine moieties of the polyamide polymer into their acid salts. Any suitable volatile organic acid can be employed to neutralize the free amine moieites of the polyamide polymer. Typical of such volatile organic acids are acetic acid, formic acid, propionic acid, butyric acid, and the like.

Once the desired aqueous admixture has been formed, a resulting aqueous admixture is formed by incorporating into the aqueous admixture the required amount of a polyepoxide. This resulting admixture is then applied to the textile substrate. The polyepoxides useful in the present invention are those characterized as having at least about two 1,2-epoxy groups, i.e.

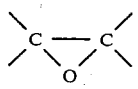

groups per molecule. Such polyepoxides can be generally represented by the formula

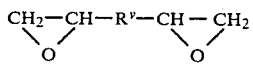

wherein $R^v$ is a saturated or unsaturated aliphatic, cycloaliphatic, alkyleneoxy aromatic, heterocyclic or epoxy-substituted aliphatic group. Typical of such groups which can be $R^v$ are $—CH_2—(CH_2)_2CH_2—$; $—CH_2—(CH_2)_4CH_2—$; $—CH_2—O—(CH_2)_4OCH_2—$;

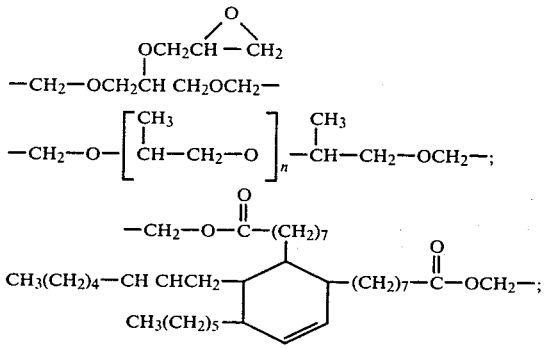

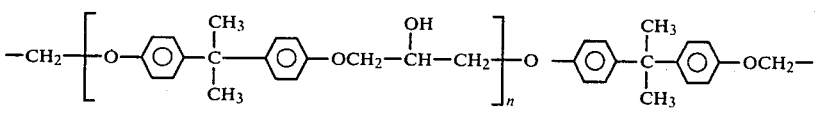

where n varies between zero and about 10.

Further, the polyepoxide may be substituted with non-interfering groups such as halogen, alkyl and alkoxy. Polyepoxides which are especially desirable are those containing terminal epoxy groups, i.e.,

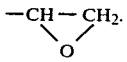

Such polyepoxides are commercially available and are marketed, for example, under the trademarks Eponite 100 and Epon 562.

The molecular weight of the polyepoxides used in forming the compositions of the subject invention which impart improved dyeing properties to textile materials containing polyolefin fibers can vary widely. Generally, however, the polyepoxides will have a molecular weight in the range of from about 90 to about 4500. Further, the polyepoxides useful in the present invention may be either water-soluble or water-insoluble. It is desirable, however, that the polyepoxide employed be water-soluble since applications of the high molecular weight polyamide polyelectrolyte and polyepoxide to the textile material are preferably accomplished by contacting the textile material with an aqueous admixture containing such constituents. If water-insoluble polyepoxides are employed, it may be desirable to incorporate into the aqueous admixture containing the polyepoxide an effective amount of a dispersing or emulsifying agent which is well known to those skilled in the art. However, the particular dispersing or emulsifying agent chosen should be inert to the desired reaction between the polyamide and the polyepoxide.

After the desired resulting aqueous admixture has been formed, it is applied, as hereinbefore described, to the textile material containing the polyolefin fibers. It may be desirable, however, prior to application of the resulting liquid admixture to the textile material to mechanically and/or chemically modify the surface of the textile material in order to enhance adhesion of the polyamide-polyepoxide reaction product to the textile material. Such methods of mechanically and/or chemically treating the surfaces of textile material containing polyolefin fibers are well-known in the art.

The compositions provided by the present invention for improving the dyeing characteristics of textile materials when applied to a textile substrate form a coherent film on the polyolefin fibers of such substrate. The makeup of the coherent film can vary, such being dependent upon the chemical makeup of the admixture applied to the substrate. For example, if the admixture applied to the substrate is an aqeuous admixture containing from 1 to about 36 weight percent of a film forming component having at least one quaternary ammonium group per molecule, as hereintofore described, the resulting coherent film will consist essentially of such a component. Further, the coherent film can consist of two or more film forming components, such as a polyamine or salt thereof having at least one quaternary ammonium group and at least two amino groups and a film forming component having at least one quaternary ammonium group, and the ratio of such components can vary widely. Generally however, it is desirable to employ the components in substantially equal amounts. However, if from about 0.2 to about 10 weight percent of a wetting agent and a minor effective amount of a fluorocarbon surfactant, such as from about 0.01 to 0.5 weight percent, is incorporated into the aqueous admixture containing the film forming component it will, in addition to the film forming component or components, contain varying amounts of the wetting agent and the fluorocarbon surfactant, the amount of such components being dependent upon the amount of each present in the admixture. Thus, desirable results can be obtained when the coherent film contains from about 7 to about 83 weight percent of the film forming component, from about 16 to about 22 weight percent of the wetting agent and from about 0.8 to about 1 weight percent of the fluorocarbon surfactant. Likewise, when the film forming component is the reaction product of a polyamine and polyepoxide, the coherent film can contain varying amounts of each component, such as from about 54 to about 59 percent of the polyamine, from about 27 to about 29 percent of the polyepoxide, and from about 17 to about 23 percent of the wetting agent and from about 0.5 to about 0.9 percent of the fluorocarbon surfactant. When the coherent film further contains a polyamide, such film can contain from about 17 to about 45 percent of a polyamine, from about 17 to about 23 percent of a polyepoxide, from about 22 to about 54 percent of the polyamide, from about 9 to about 11 percent of the wetting agent and about 0.5 percent of the fluorocarbon surfactant.

In order to further illustrate the invention the following examples are given. However, it is to be understood that such examples are given for illustrative purposes only and are not to be construed as unduly limiting the subject invention as set forth hereinafter in the claims.

PREPARATION I

A 600 milliliter glass beaker, equipped with an overhead stirrer and positioned on a hot plate, was charged with 257.4 grams of an aqueous admixture containing 5 weight percent of a high molecular weight polyamine having at least one quaternary ammonium group and at least two amino groups having active hydrogen per molecule (commerically available under the trademark Lufax 295). The aqueous admixture was then heated to about 50° C. Thereafter, 64 grams of a polyamide having the general formula

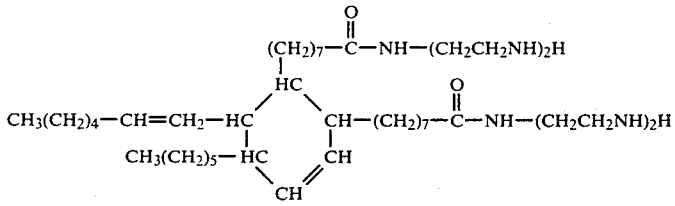

and 25.6 grams of glacial acetic acid was then incorporated into the aqueous admixture to form the acetate salt of the above-described polyamide. Thereafter, 20 grams of an alkoxylated phenol wetting agent (Syn Fac 905) and 1.0 gram of a fluoroalkyl carboxylate surfactant (Flourad FC-128). After the above ingredients had been charged, 32 grams of a polyepoxy compound having the general formula

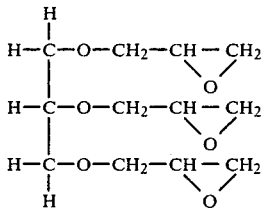

and having an average of about 2.6 epoxy groups per molecule was incorporated into the aqueous admixture to provide a resulting aqueous admixture. Stirring of the resulting aqueous admixture was continued until a homogeneous admixture was obtained. The pH of the resulting admixture was then measured and determined to be between 4.5–5.5

PREPARATION II

A 1 liter round bottom flask equipped with a stirrer, a heating mantle, a thermometer, a reflux condenser and a dropping funnel, was charged with 243.4 grams of water. The water was heated to 85° C. and thereafter 32 grams of a high molecular weight polyamine having at least one quaternary ammonium group and at least two amino groups having active hydrogen (commerically available under the trademark Lufax 295) was charged to the heated water and stirring was continued until substantially all of the polyamine had dissolved in the water. Thereafter 40 grams of ammonium hydroxide was added and the pH of the aqueous admixture determined to be between 7.5–9.5. Sufficient acetic acid was then added to adjust the pH of the polyamine containing aqueous admixture to between 4.5–5.5. The aqueous admixture was then allowed to cool to 50° C. To the cooled aqueous admixture are charged 32 grams of a polyamide having the formula

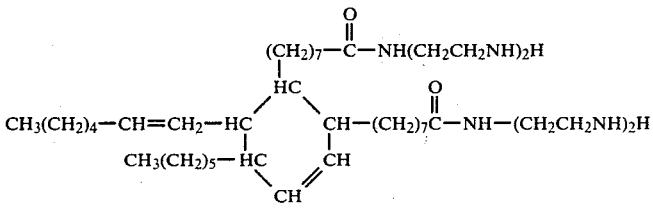

20 grams of an alkoxylate phenol wetting agent containing an average of 9 moles of ethylene oxide and 1.0 grams of a fluoroalkyl carboxylate surfactant. The pH of the homogeneous admixture was then measured and determined to be between 4.5–5.5.

To the above formed aqueous admixture was charged 32 grams of polyepoxy compound described in Preparation I and stirring was continued until a homogeneous resulting aqueous admixture was formed. The pH of the resulting aqueous admixture was determined to be between 4.5–5.5.

PREPARATION III

A 1 liter round bottom flask equipped with a stirrer, a heating mantle, a thermometer, a reflux condenser and a dropping funnel, was charged with 207 grams of water. The water was heated to 85° C. and thereafter 40 grams of a high molecular weight polyamine having at least one quaternary ammonium group and at least two amino groups having active hydrogen (commercially available under the trademark Lufax 295) was charged to the heated water and stirring was continued until substantially all of the polyamine had dissolved in the water. Thereafter 75 grams of ammonium hydroxide was added and the pH of the aqueous admixture determined to be between 7.5–9.5. Sufficient acetic acid was then added to adjust the pH of the polyamine containing aqueous admixture to between 4.5–5.5. The aqueous admixture was then allowed to cool to 50° C. To the cooled aqueous admixture are charged 20 grams of an alkoxylate phenol wetting agent containing an average of 9 moles of ethylene oxide and 1.0 gram of a fluoroalkyl carboxylate surfactant. The pH of the homogeneous admixture was then measured and determined to be between 4.5–5.5.

To the above formed aqueous admixture was charged 32 grams of polyepoxy compound described in Preparation I and stirring was continued until a homogeneous resulting aqueous admixture was formed. The pH of the resulting aqueous admixture was determined to be between 4.5–5.5.

PREPARATION IV

A. A 250 milliliter flask equipped with a magnetic stirrer, a reflux condenser, and an electric heating mantle was charged with 91 grams of toluene, 24 grams of a tris-2-aminopropylether of a triol, a polyamine having a molecular weight of about 400, and 3.7 grams of a polyepoxy compound as set forth in Preparation I. The mixture was reluxed for 1.5 hours after which 10 grams of dimethyl sulfate was added dropwise to the reaction mixture. Care was exercised to insure that the rate of addition of the dimethyl sulfate did not cause the reflux condenser to be flooded. The resulting mixture when then refluxed for 2 additional hours after which the solvent was removed from the reaction mixture by evaporation yielding a glassy, solid water-soluble product. The product was then made into the following formulation.

B. A 600 milliliter beaker, equipped with an overhead stirrer, was placed on a hot plate and 283 grams of water was charged to the beaker. The water was heated to 50° C. and thereafter 28 grams of the product produced in (a) above was charged to the heated water. 34 grams of a tris-2-aminopropyl ether of a triol, a polyamine having a molecular weight of about 400 was charged to the reaction mixture resulting in an admixture having a pH of 8.7. An effective amount of acetic acid was incorporated into the reaction mixture to lower the pH of same to a range of 4.5 to 5.5 and to neutralize the free amine moieties of the components of the admixture. 34 grams of the polyepoxy compound, 1.0 grams of the fluorocarbon surfactant and 20 grams of the wetting agent, such as set forth in Preparation I were incorporated into the aqueous admixture and the resulting aqueous admixture was stirred until a homogeneous admixture was formed.

PREPARATION V

A. A 250 milliliter glass beaker, equipped with an overhead stirrer was charged with 109 grams of water. To the stirring water 10 grams of an alkoxylate phenol wetting agent, 0.5 gram of a fluoroalkyl carboxylate salt of a fluorocarbon surfactant, and 80 grams of an aqueous emulsion containing 60% of an acrylic emulsion polymer having quaternary ammonium salt groups were added and stirring was continued until a substantially homogeneous admixture was obtained. The homogeneous admixture had a pH between 2.5–5.5.

B. A glass beaker, equipped with an overhead stirrer, was charged with 96 grams of water and 104 grams of an aqueous emulsion containing 46% of an acrylic emulsion polymer having quaternary ammonium salt groups. The resulting aqueous admixture was stirred until a homogeneous admixture having a pH between 2.5–5.5 was obtained.

C. A glass beaker, equipped with an overhead stirrer, was charged with 120 grams of water and 80 grams of an aqueous emulsion containing 60% of an acrylic emulsion polymer having quaternary ammonium salt groups. (The polymer was the same as used in (A) of this Preparation.)

D. A glass beaker, equipped with an overhead stirrer, was charged with 85 grams of an aqueous admixture containing 5 weight percent of a high molecular weight polyamine having at least one quaternary ammonium group and at least two amine groups having active hydrogen per molecule (commercially available under the trademark Lufax 295), 10 grams of an alkoxylated phenol wetting agent (Syn Fac 905) 0.5 gram of a fluoroalkyl carboxylate surfactant and 104 grams of an aqueous emulsion containing 46% of an acrylic emulsion polymer having quaternary ammonium salt groups. The resulting aqueous admixture was stirred until a homogeneous admixture having a pH between 2.5–5.5 was obtained.

E. A glass beaker, equipped with an overhead stirrer, was charged with 109 grams of an aqueous admixture containing 5 weight percent of a high molecular weight polyamine having at least one quaternary ammonium group and at least two amine groups having active hydrogen per molecule (Lufax 295), 10 grams of an alkoxylated phenol wetting agent (Syn Fac 905), 0.5 gram of a fluoroalkyl carboxylate salt fluorocarbon surfactant (Fluorad FC-128) and 80 grams of an aqueous emulsion containing 60% of an acrylic emulsion polymer having quaternary ammonium salt groups. The resulting aqueous admixture was stirred until a homogeneous admixture having a pH between 2.5–5.5 was obtained.

EXAMPLE I

Application

Each of the above-described Preparations I, II and III were diluted with water to provide a 5% add-on of the film forming constituents to a substrate formed of polypropylene fibers. Such was accomplished by using a pad roll at 50% wet add-on. The polymer-modified substrates were then placed in a dispatch oven and dried at 250° F. for four minutes and thereafter the temperature of the oven was raised to 280° F. and the dried samples were cured for an additional eight minutes.

The above polymer-modified substrate using Preparations I, II and III and an unmodified substrate identical to the substrates used in the above treatments, were tufted into carpet swatches with a loop stitch using nylon 66 carpet yarn. The carpet swatches were then Kuster dyed as follows:

Dyeing

A dye mix formulation was prepared by charging to a mixing vessel 3738.5 grams of cold water and 1250 grams of an antimigrant. (Syn Gum D-47D). The admixture was stirred until an aqueous solution resulted. Thereafter, 1.5 grams of monosodium phosphate, 5 grams of a wetting agent (Syn Wet K-1) and 5 grams of a dyestuff, Erionyl yellow 4R, were charged to the aqueous solution and agitation was continued until a homogeneous solution having a viscosity of 45–55 cps resulted.

The carpet swatches were saturated with water and thereafter Kuster dyed using the above-described dye formulation. The Kuster dyeing process was carried out at run speed of 70–75 rpms, such providing a 250% wet pickup on the carpet swatches and thus a dyeing level of 0.25%.

The Kuster dyed swatches were then placed in a steamer maintained at 212° F. for 10 minutes and thereafter washed with water to remove residual dye. The washed swatches were then centrifuged, dried and examined.

Results

Each of the carpet swatches having a backing or substrate modified with the film forming components of Preparations I, II and III exhibit a substrate formed of polypropylene fibers which was dyed to a shade corresponding to the shade of the dyed nylon carpet fibers. However, the carpet swatch formed of an unmodified substrate containing polypropylene fibers had no surface dyeing.

EXAMPLE II

Application

The preparations of Preparations IV and V were each diluted with water to provide a 5% add-on of the film forming constituents to a substrate formed of polypropylene fibers. Such was accomplished by using a pad roll at 50% wet add-on. The polymer modified substrates were then dried at 220° F. for about 4 minutes and thereafter cured for about 4 minutes at 235° F.

Dyeing

The polymer modified substrates prepared in Example II were dyed by the following method. To a 250 milliliter beaker, equipped with magnetic stirring and hot plate heating, a 0.5% solution of Erionyl yellow 4R in water was added and heated to 150° F. The polymer modified substrates prepared in Example II were placed in the beaker for 5 minutes and then rinsed with warm water, dried and examined.

Results

Each of the carpet swatches formed using a preparation of Preparation IV to provide polymer-modified backing or substrate, dyed thus illustrating dye-uptake by the modified substrate. The swatches containing, in addition to the acrylic polymer, the high molecular weight polyamine having at least one quaternary ammonium group and at least two amine groups having active hydrogen per molecule, showed better dyeing properties than those which did not containing the high molecular weight polyamine. However, the polymer-modified substrate wherein the film forming polymer constituent was prepared as in Preparations II and V showed the best improvement in dyeing properties of a substrate containing polyolefin fibers.

That which is claimed is:

1. A method for improving the dyeing characteristics of textile materials containing polyolefin fibers by surface modification of such textile materials which comprises:

(a) forming an aqueous admixture consisting essentially of from about 1 to about 36 weight percent of a film forming component containing at least one quaternary ammonium group per molecule, from about 2 to about 10 percent of a wetting agent and from about 0.01 to about 0.5 weight percent of a fluorocarbon surfactant;

(b) adjusting the pH of the aqueous admixture with an effective amount of pH adjusting agent to provide a pH range for said aqueous admixture of from about 2.0 to about 6.0;

(c) applying said aqueous admixture to said textile materials to wet the polyolefin fibers of said materials; and (d) heating the wetted textile materials to a temperature effective to remove water and allow formation of coherent film on said polyolefin fibers.

2. The method of claim 1 wherein said film forming component having at least one quaternary ammonium group per molecule contains at least one functional group represented structurally as

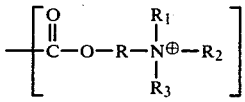

wherein R is an alkyl, alkylene, cycloalkyl or cycloalkylene group, $R_1$ and $R_3$ are similar moieties containing from 1 to about 7 carbon atoms selected from the group consisting of alkyl or alkyl substituted aromatic groups, and $R_2$ is an alkyl, alkylene, cycloalkyl or alkyl substituted aromatic group.

3. The method of claim 2 wherein said aqueous admixture further includes from about 1 to about 36 weight percent of a film forming polyamine containing at least one quaternary ammonium group and at least two amino groups per molecule.

4. The method of claim 3 wherein said film forming polyamine contains at least one functional group represented structurally as

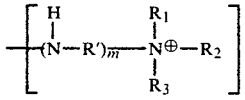

wherein $R_1$ and $R_3$ are similar moieties containing from 1 to about 7 carbon atoms and selected from the group consisting of alkyl or alkyl substituted aromatic groups, $R_2$ and R′ are selected from the group consisting of cycloaliphatic, aromatic, polyalkyleneoxy, or amino-substituted alkyl groups, m is an integer of at least 1, and the total —NH— groups in said functional group is at least 2.

5. The method of claim 2 wherein said heating is carried out at a temperature of from about 250° F. to about 280° F.

6. The method of claim 2 wherein said wetting agent is an alkoxylated phenol or an alkoxylated $C_{10}$–$C_{18}$ alcohol.

7. The method of claim 6 wherein said fluorocarbon surfactants are fluoroalkyl carbonate salts, fluoroalkyl alkoxylates, fluoroalkyl sulfonate salts, fluoroalkyl quaternary ammonium salts and fluoroalkylates.

8. A method for improving the dyeing characteristics of textile materials containing polyolefin fibers which comprises:

(a) forming an aqueous admixture consisting essentially of from about 1 to about 36 weight percent of a film forming polyamine having at least one quaternary ammonium group and at least two amino groups having active hydrogen per molecule, from about 2 to about 10 percent of a wetting agent and from about 0.01 to about 0.5 weight percent of a fluorocarbon surfactant;

(b) adjusting the pH of the aqueous admixture with an effective amount of a volatile organic acid to provide a pH range for acid aqueous admixture of from about 2.0 to about 6.0 and to further neutralize the amino groups having active hydrogen of said polyamine;

(c) incorporating into the pH adjusted aqueous admixture from about 0.5 to about 16 weight percent of a polyepoxide having at least two 1,2-epoxy groups per molecule to form a resulting aqueous admixture;

(d) applying said resulting aqueous admixture to said textile materials to wet the polyolefin fibers of said materials; and (e) heating the wetted textile materials to a temperature effective to remove water and volatile organic acids regenerated by such heating and thus free the amino groups of said compound for reaction with said polyepoxide to provide a film forming reaction product as a coherent film on said fibers.

9. The method of claim 8 wherein said polyamine is represented structurally as

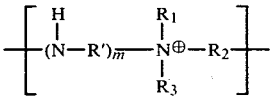

wherein $R_1$ and $R_3$ are similar moieties selected from alkyl or a substituted moiety containing from about 1 to about 7 carbon atoms and $R_2$ and R′ are alkyl, cycloaliphatic, aromatic, polyalkyleneoxy, or an amino-substituted alkyl group.

10. The method of claim 8 wherein said polyepoxide is represented by the general formula

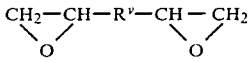

wherein $R^v$ is an aliphatic, cycloaliphatic, aromatic or heterocyclic group and has a molecular weight of from about 90 to about 4500.

11. The method of claim 10 wherein said polyamine is represented structurally as

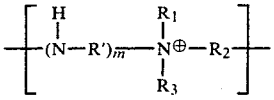

wherein $R_1$ and $R_3$ are similar moieties selected from alkyl or a substituted moiety containing from about 1 to about 7 carbon atoms and $R_2$ and R′ are alkyl, cycloaliphatic, aromatic, polyalkyleneoxy, or an amino-substituted alkyl group.

12. The method of claim 10 wherein said polyamine has a molecular weight of at least 600.

13. The method of claim 12 wherein said heating is carried out at a temperature of from about 250° F. to about 280° F.

14. The method of claim 13 wherein said wetting agent is an alkoxylated phenol or an alkoxylated $C_{10}$ to $C_{18}$ alcohol.

15. The method of claim 14 wherein said fluorocarbon surfactants are fluoroalkyl carbonate salts, fluoroalkyl alkoxylates, fluoroalkyl sulfonate salts, fluoroalkyl quaternary ammonium salts and fluoroalkylates.

16. The method according to claim 13 which further includes admixing into said aqueous admixture from about 0.5 to about 50 weight percent of an amine-terminated polyamide polymer and an effective amount of a volatile organic acid to substantially neutralize free amino moieties of said polyamide polymer.

17. The method according to claim 16 wherein said amine-terminated polyamide polymer contains at least one functional group represented structurally as

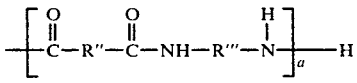

wherein R″ is an alkyl, alkylene, cycloalkyl or cycloalkylene group, R‴ is an alkyl, cycloaliphatic, aromatic or amine substituted alkyl group, and α is an integer of from 1 to about 10.

* * * * *

UNITED STATES PATENT AND TRADEMARK OFFICE

CERTIFICATE OF CORRECTION

PATENT NO. : 4,263,009

DATED : April 21, 1981

INVENTOR(S) : Ralph N. Brendle, John W. Miley and George A. Allen

It is certified that error appears in the above-identified patent and that said Letters Patent is hereby corrected as shown below:

Column 2, line 40, after formula, add --, per molecule.--.

Column 3, line 11, after "fibers" insert --having--.

Column 3, line 57, after "to" insert --about--.

Column 3, line 64, change "means" to --mean--.

Column 6, line 11, after "aqueous" insert --admixture--.

Column 6, line 53, after "to" insert --about--.

Column 7, line 68, after "insure" insert --that--.

Column 16, line 33, after "(Syn Fac 905)" insert --,--.

Column 16, line 48, change "Fluorad" to --Flourad--.

Column 17, line 12, change "(Syn" to --(Syno--.

UNITED STATES PATENT AND TRADEMARK OFFICE

CERTIFICATE OF CORRECTION

PATENT NO. : 4,263,009

DATED : April 21, 1981

INVENTOR(S) : Ralph N. Brendle, John W. Miley and George A. Allen

It is certified that error appears in the above-identified patent and that said Letters Patent is hereby corrected as shown below:

Column 19, line 24, after "for" insert --said--.

Column 20, line 42, change "amino" to --amine--.

Signed and Sealed this

*Seventeenth* Day of *September 1985*

[SEAL]

*Attest:*

*Attesting Officer*

DONALD J. QUIGG

*Commissioner of Patents and Trademarks—Designate*